US009177693B2

(12) United States Patent
Frasure et al.

(10) Patent No.: US 9,177,693 B2
(45) Date of Patent: Nov. 3, 2015

(54) HIGHLY INTEGRATED DATA BUS AUTOMATIC FIRE EXTINGUISHING SYSTEM

(71) Applicant: Hamilton Sundstrand Corporation, Windsor Locks, CT (US)

(72) Inventors: David Frasure, Wilson, NC (US); Robert Jeffrey Norris, Wilson, NC (US); John Wetzork, Claremont, CA (US); Bruce Embry, Wilson, NC (US); Johnny Dewayne Wyatt, Nightdale, NC (US); James Cooke, Cary, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 19 days.

(21) Appl. No.: 13/964,812

(22) Filed: Aug. 12, 2013

(65) Prior Publication Data

US 2014/0048330 A1 Feb. 20, 2014

Related U.S. Application Data

(62) Division of application No. 12/685,699, filed on Jan. 12, 2010, now Pat. No. 8,511,397.

(51) Int. Cl.

| | |
|---|---|
| ***A62C 37/40*** | (2006.01) |
| ***A62C 37/36*** | (2006.01) |
| ***H01B 7/00*** | (2006.01) |

(52) U.S. Cl.

CPC ..... *H01B 7/0045* (2013.01); *A62C 37/04* (2013.01); *A62C 37/40* (2013.01)

(58) Field of Classification Search

CPC ..... A62C 37/04; A62C 37/40; A01B 7/0045
USPC ..... 169/54, 56, 60, 61
See application file for complete search history.

(56) References Cited

U.S. PATENT DOCUMENTS

| | | | | |
|---|---|---|---|---|
| 4,351,394 | A * | 9/1982 | Enk | 169/61 |
| 4,380,760 | A | 4/1983 | Kornblit | |
| 4,695,952 | A | 9/1987 | Howland | |
| 4,755,687 | A | 7/1988 | Akiba et al. | |
| 4,933,667 | A | 6/1990 | Shaw et al. | |
| 5,117,219 | A * | 5/1992 | Tice et al. | 340/518 |
| 5,236,049 | A | 8/1993 | Asselin et al. | |
| 5,309,146 | A | 5/1994 | Kenet | |

(Continued)

FOREIGN PATENT DOCUMENTS

| | | |
|---|---|---|
| CN | 2382076 | 6/2000 |
| EP | 0011461 A1 | 5/1980 |

(Continued)

OTHER PUBLICATIONS

U.S. Appl. No. 12/470,817, filed May 22, 2009, "Fire Suppression System and Method".

(Continued)

*Primary Examiner* — Ryan Reis
(74) *Attorney, Agent, or Firm* — Carlson, Gaskey & Olds, P.C.

(57) ABSTRACT

A wiring harness for a fire extinguishing system including a connector that has a pair of power leads and a pair of command leads. At least one zone identification element is in communication with the connector and is configured to provide a zone location assignment to the connector.

8 Claims, 1 Drawing Sheet

(56) References Cited

U.S. PATENT DOCUMENTS

| | | | | |
|---|---|---|---|---|
| 5,350,019 | A | 9/1994 | Igarashi | |
| 5,470,253 | A * | 11/1995 | Siems et al. | 439/491 |
| 6,173,814 | B1 | 1/2001 | Herkel et al. | |
| 6,263,269 | B1 | 7/2001 | Dannenberg | |
| 6,651,900 | B1 | 11/2003 | Yoshida | |
| 6,798,341 | B1 | 9/2004 | Eckel et al. | |
| 6,851,483 | B2 | 2/2005 | Olander et al. | |
| 6,912,429 | B1 | 6/2005 | Bilger | |
| 7,048,068 | B2 * | 5/2006 | Paulkovich | 169/16 |
| 7,304,567 | B2 | 12/2007 | Canfield | |
| 7,468,661 | B2 | 12/2008 | Petite et al. | |
| 7,849,931 | B2 * | 12/2010 | Ng | 169/62 |
| 2003/0050713 | A1 | 3/2003 | Piersanti et al. | |
| 2006/0118323 | A1 * | 6/2006 | Kalisz et al. | 174/113 R |
| 2006/0236013 | A1 | 10/2006 | Okeda | |
| 2006/0253726 | A1 | 11/2006 | Kukshya et al. | |
| 2007/0008099 | A1 | 1/2007 | Kimmel et al. | |
| 2007/0188984 | A1 * | 8/2007 | Opsitos | 361/600 |
| 2007/0241875 | A1 | 10/2007 | Costa | |

FOREIGN PATENT DOCUMENTS

| | | | |
|---|---|---|---|
| GB | 2169421 | A | 7/1986 |
| JP | 2004192245 | A | 7/2004 |
| JP | 2006227783 | A | 8/2006 |
| TW | 200941921 | A | 10/2009 |
| WO | 03024534 | | 3/2003 |
| WO | 03068323 | | 8/2003 |

OTHER PUBLICATIONS

U.S. Appl. No. 12/474,354, filed May 29, 2009, "Combined Passive and Active Vehicle Fire Prevention System".

Great Britain Application No. 0915123.4, filed on Aug. 27, 2009 "Fire Suppression System With Pressure Regulation".

Extended European Search Report for Application No. EP11 25 0036 dated Sep. 21, 2011.

Written Opinion for Singapore Application No. 201100165-8, Nov. 7, 2012.

EP Examination Report for Application No. 11250036.78 dated Nov. 27, 2014.

EP Extend Search Report for Application No. 115156508.2 date completed May 28, 2015.

EP Extend Search Report for Application No. 15156503.3 date completed May 27, 2015.

* cited by examiner 10
11
12
14
16
18
20
22
24
25
26
27
28
29
30
32
34
36
38
40
42
44
46
48
49
50
52
54
56
58

HIGHLY INTEGRATED DATA BUS AUTOMATIC FIRE EXTINGUISHING SYSTEM

RELATED APPLICATION

This is a divisional application of U.S. patent application Ser. No. 12/685,699 filed on Jan. 12, 2010.

BACKGROUND

This disclosure relates to an integrated data bus automatic fire extinguishing system.

Fire extinguishing systems often have multiple zones, which cover numerous suppression areas. Each zone typically includes one or more detectors, suppressors and activation devices. Fire extinguishing systems are typically centralized and use a common controller to activate the suppressors in the various zones, making zone operation dependent upon the controller. That is, a detector sends a detection signal to the controller, which determines whether or not to activate the suppressors in a given zone. The controllers are specific to the number and configuration of the zones and can be quite large.

The number and size of wires in the system affects system packaging and weight. Assuming at least three to four wires are desired per detector and/or suppressor, a system utilizing a combination of fifteen detectors and suppressors, for example, could require as many as sixty wires connected directly to the same controller, which does not include wires that would be desired for any ancillary components. A fully redundant system would require twice the amount of wires. Moreover, two wires to each suppressor, for example, are typically power wires that are sized to provide sufficient current to an actuation device. These power wires may extend over long distances, significantly contributing to the weight of the system, which is especially undesirable for mobile applications, such as aircraft.

SUMMARY

In one exemplary embodiment, a wiring harness for a fire extinguishing system including a connector that has a pair of power leads and a pair of command leads. At least one zone identification element is in communication with the connector and is configured to provide a zone location assignment to the connector.

In a further embodiment of the above, the zone identification element is a resistor that corresponds to the zone location assignment.

In a further embodiment of the above, the zone identification element is at least one pin providing a binary number that corresponds to the zone location assignment.

In a further embodiment of the above, a detector is connected to the connector. The detector takes the zone location assignment.

In a further embodiment of the above, a suppressor is connected to the connector. The suppressor takes the zone location assignment.

In a further embodiment of the above, a zone, that includes multiple connectors that have zone identification elements corresponds to the same zone location assignment.

BRIEF DESCRIPTION OF THE DRAWINGS

The disclosure can be further understood by reference to the following detailed description when considered in connection with the accompanying drawings wherein.

DETAILED DESCRIPTION

Figures 1A, 1B, 2, 3, 4:
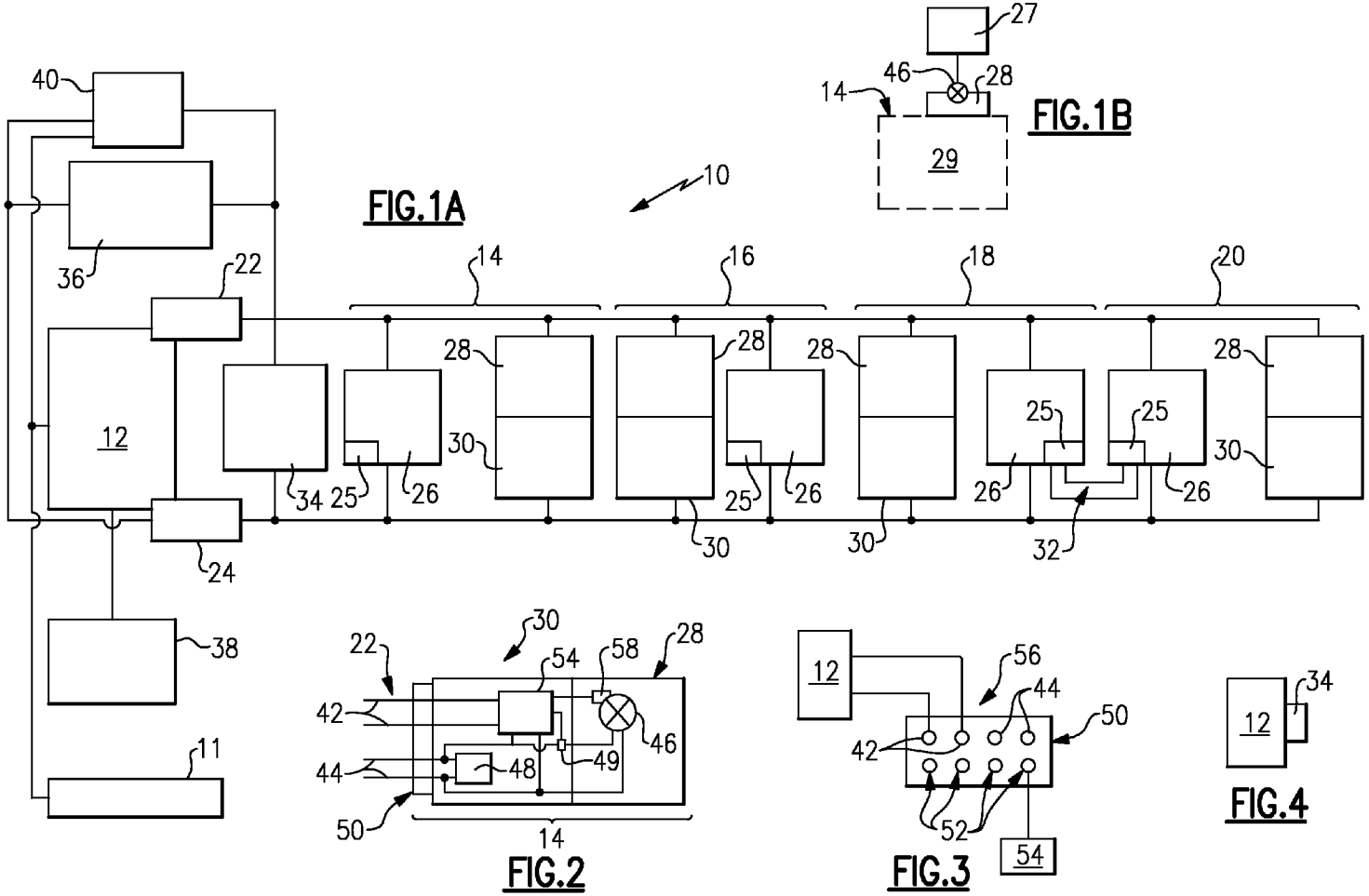
FIG. 1A is a schematic view of an example integrated data bus automatic fire extinguishing system.
FIG. 1B is a schematic view of a suppressor and suppressant source.
FIG. 2 is a schematic view of an example fire activation module.
FIG. 3 is a schematic view of a connector and microprocessor.
FIG. 4 is a schematic view of a controller with a removable network configuration device.

A Highly Integrated Data Bus automatic fire extinguishing system 10 ("HIDB system" or "system") (see FIG. 1A) is configured to automatically perform fire detection and fire extinguishing, as well as explosion detection and explosion suppression functions for fixed structures (buildings, warehouses, etc.), on road, off road, military, commercial, and rail guided vehicles, as well as aircraft and marine vehicles. The HIDB system 10 includes a single zone, or multiple separate zones (for example, zones 14, 16, 18, 20) in a data bus network. A zone is defined as a specific suppression area 29 (see FIG. 1B) to be protected. For example, an engine compartment, auxiliary power unit compartment, a passenger compartment, stowage or cargo bays, wheel wells and tires, external vehicle areas, crew or passenger egress doors, warehouse or manufacturing areas, etc. There is no practical limit to the number of zones or the number of components attached to the HIDB system 10.

Referring to FIG. 1A, the HIDB system 10 provides for the rapid detection of explosion events with fast reaction times in order to suppress the explosion before it has a chance to mature (typically response times are in the 6-10 ms range for detection and initiation of suppressor activation), and/or fire detection and extinguishing, which can have response times measured in seconds. Information is broadcast to a first data bus 22 to and from a controller 12 and components within the zones 14, 16, 18, 20, for example. A second data bus 24 may be used for redundancy. Each data bus 22, 24 includes command leads 42 and power leads 44, best shown in FIG. 2.

In the example, each zone includes at least one detector 26, suppressor 28 and fire extinguishing activation module (FAM) 30, which may be separate or integrated into a variety of configurations. The FAMs 30 activate the suppressors 28, which are connected to a suppression source 27, to selectively disperse suppressant into the suppression area, as illustrated in FIG. 1B. The data buses 22, 24 are directly connected and common to the detectors 26, suppressors 28 and FAMs 30 of the zones 14, 16, 18, 20.

The controller 12 may contain a single or multiple processors, as well as Non-Volatile Random Access Memory (NVRAM) used for storing a history of events, faults, and other activities of the devices on the data bus network. This NVRAM can be used as the source for reports, maintenance actions and other activities.

The controller 12 has the ability to communicate with any device (for example, detectors 26, suppressors 28, FAMs 30) on the data bus network, which are illustrated in FIG. 1A. Such communication would be to command that a device or devices perform specific functions and receive their response information, as well as receive unsolicited information from any device on the network. The controller 12 monitors all of the network devices to ensure that they are operational, or to deactivate, or reactivate specific devices on the network. The HIDB system 10 is designed to be autonomous regarding the detection and the extinguishing of fires and explosions. To this end, each detector 26 and FAM 30 includes at least one microprocessor configured to operate independently of the controller 12. The example HIDB system 10, however, does provide overrides for manual activations of the system within the network zones.

An optional computer data bus communication link 38 coordinates all communications with the controller 12, respond to requests, and also broadcasts unsolicited information to the controller 12.

The controller 12 can be programmed to handle a specific network configuration, that is, for example, a specified number of detectors 26 and suppressor 28 in an engine bay, a specified number in a crew compartment, cargo compartment, etc. At controller 12 power-up, the controller 12 would verify that each detector 26, suppressor 28, FAM 30 and ancillary components (if they are used), are all in place and functioning correctly by zone. Any malfunctioning or missing components would be reported accordingly.

The controller 12 may have its own built-in control panel on it (buttons, lights, switches, for example), or it can be a "black box" tucked away someplace with an optional remote control panel(s) to provide control, or it can have both its own built-in control panel as well as a remote control panel(s). Sometimes more than one control panel is desired, as certain crew members may be isolated from the vehicle operators, or in the case of a building, may require several control panels for testing or accessing the network components.

The data buses 22, 24 minimize the number of wires that must that are used to directly connect detectors 26, suppressors 28, FAMs 30 and other ancillary devices or components. Utilizing a single Controller Area Network (CAN) or similar data bus, for example, only requires four wires, which are a pair of command leads (CAN Hi, CAN Low) and a pair of power leads, which handle all detectors 26, suppressors 28, FAMs 30 and ancillary components attached to the network. A dual data bus system with a second data bus 24, providing complete redundancy, would only require eight wires in such a configuration.

Data bus control is provided by the controller 12. In the example, the controller 12 is designed to handle two independent and redundant data buses 22, 24. Both data buses 22, 24 send the same information to network components (detectors 26, suppressors 28 and FAMs 30) and those components send their data to the controller 12 over both data buses 22, 24. A redundant data bus is used when communication to and from network devices is critical. For example, in a combat vehicle redundant paths may be desired if the vehicle suffers combat damage. The data bus wiring would typically be routed via different, well separated paths through the vehicle, only coming together at the particular component connector. In that manner, if one data bus communication links has been disabled, communication is still available via the second data bus. Where applications only require one path of communication, then a single data bus may be used.

The HIDB system 10 provides detectors 26 for detection of a suppression event, which includes fires and explosions, using several different detection logic schemes, such as, but not limited to:

1) OR logic (any detector 26 in a zone can initiate a discharge of a fire extinguisher or explosion suppressor, both of which are referred to as a "suppressor 28"),
2) AND logic which requires that more than one detector 26 in a zone must detect the event before activating a suppressor 28,
3) Discrimination between different types of fire and non fire events.

The HIDB system 10 can use multiple types of detectors 26, such as, but not limited to optical (typically explosion and fire detection), thermal (thermistor, eutectic, for example; typically used in fire detection), pressure (typically explosion detection) and other types.

The detector 26 contains a microprocessor 25, which interfaces with the electronic circuitry or device which actually determines if there is a fire or explosion event. This microprocessor 25 can also be the interface to the data buses 22, 24. In addition, the microprocessor 25 may determine if there is a fire or explosion event. This would typically be determined by the microprocessor 25 computing speed, and/or the complexity of performing the detection methodology. If the detector 26 determines that a suppression event has occurred (fire or explosion, for example), then the detector 26 sends a command to the desired suppressors 28 in the zone where the event has been detected (and could include adjacent zones depending upon the desired system logic) over the data buses 22, 24 through a FAM 30, for example.

In one example, each detector 26 has the ability to perform a Built In Test (BIT) of itself to determine if it is functioning properly. It can perform BIT on a periodic basis, or by command from the controller 12, and report the status to the controller 12. A faulted detector 26 may be self-deactivated, or deactivated by the controller 12. Deactivation assists in dynamic changes to the ANDing logic, described below.

If OR logic is being used, upon detection of an event, the detector 26 would broadcast a message over the data bus commanding that all FAMs 30 in the same zone as the detector 26 activate their suppressor 28. However, by design, it could also command other suppressors 28 in adjacent zones to activate their suppressors 28 depending upon the logic provided by the customer.

IF ANDing or discrimination logic is used, the desired number of detectors 26 in each zone will detect the event before a command can be issued to have the FAMs 30 activate the suppressors 28 in the desired zone(s). At power-up, it is determined by each detector 26 whether it should use ANDing logic via the data bus, or use discrete wiring 32, which provides faster ANDing logic capability. If ANDing logic is used over the data bus, then each detector 26 in the zone would broadcast messages to every other detector 26 in the zone when an event was detected. When the desired number of detectors 26 are detecting the event, then any or all of the detectors 26 in the zone that are detecting the event can command the FAMs 30 to activate the desired suppressors 28. Additionally, for example, the detectors 26 in a zone could broadcast over that data bus that they have detected an event and the FAM(s) 30 located in a zone could count the number of detectors 26 within that zone that have detected the fire, and when the required number has been achieved, the FAM(s) 30 could activate the suppressors 28 in that zone, and if required in adjacent zones. This logic could be communicated to the FAM(s) 30 during power up by a Network Configuration Device (NCD 34), discussed in more detail below.

Inherent in the logic described above, is the ability to dynamically reduce the number of detectors 26 detecting an event in order for the command to be given to the FAMs 30 to activate the suppressors 28. For example, if two out of four detectors in a zone are desired to detect an event before issuing a command to the FAMs 30, it can be determined via the single or dual data buses if, indeed, the other detectors 26 are operational. Some of the detectors 26 could have been disabled by the event, and thus logic can be incorporated to command the FAMs 30 to activate the suppressors 28 if all the FEDs 26 are not operational within a given zone. Whatever dynamically changing logic is desired, it may be accomplished by the detectors 26 determining the status of the other detectors 26 within a zone over the single or dual data bus.

The controller 12 will also "see" any of the above command messages, and store this event traffic in its NVRAM. It can also verify that each FAM 30 has taken the commanded action, and that indeed each suppressor 28 was successfully activated by communication with each FAM 30 in the zone. It can also determine what detectors 26 are not functioning properly.

Since the detector 26 contains a microprocessor 25, another option that can be used in the detector 26 is to download into its NVRAM the CAGE code, Part Number, and Serial Number (for that particular unit) at the time of manufacturer. When a unit is faulted, the controller 12 can issue a message as to the zone, part number, and serial number of the unit that is faulted. Since a physical nameplate typically is also on the detector 26, the part number and serial number on the nameplate will aid the system maintainer in identifying the component to be replaced.

IF ANDing logic is used over dedicated discrete wires connecting all detectors in a zone with each other (for example, by wires 32), then the same dynamic changing logic can be introduced as was described above relative to the detectors 26. In one example, a tri-voltage signaling scheme is used, but other schemes could also be used. For example, if a detector 26 is operational, it outputs a voltage signal within a given mid-range (for example 6-10 volts) over the discrete line 32 indicating it is operational. If the detector 26 detects an event, it would increase the voltage to a higher level, for example 12-16 volts. If the voltage falls below 5 volts (0-5 volts) it is an indication that the detector 26 is not functioning properly. Therefore, by each detector 26 discretely looking at the output voltages of the other detectors 26 within a zone, it can determine if all detectors 26 are operational, how many detectors 26 may be in alarm, and how many are not functioning correctly. Therefore, the correct decision using ANDing logic can be made, and if one or more of the detectors 26 are not functioning properly, the logic can be adjusted dynamically to command the FAMs 30 to activate their suppressors 28.

Referring to FIG. 2, the FAM 30 is a module, which can be an integral part of a suppressor 28, or a separate module, which is located in close proximity to the suppressor 28. The FAM 30 contains a microprocessor 54, which interfaces with the electronic circuitry or device, which actually activates the suppressor 28 upon command from the detectors 26 or a manual discharge command from the controller 12. This microprocessor 54 can also monitor the condition of the activation device (such as bridgewire continuity), and/or pressure switches/pressure transducers which report/indicate the pressure within the suppressor 28. This microprocessor 54 can also be the interface to the data buses 22, 24. The FAM 30 would report any faults associated with the suppressor 28 over the data bus(es).

The HIDB system 10 incorporates the use of one or more capacitors 48 in the FAM 30, which, upon command from the microprocessor 54, provides the necessary power to activate a suppressor 28. As a result, smaller power leads 44 can be used having a current capacity that would not be able to meet the instantaneous actuation current draw of the actuation device 46. The power requirements for an actuation device 46, such as a valve or other mechanism, in each suppressor 28 determines the capacitor size within the FAM 30. The FAM 30 may be integrated with or remote from the suppressor 28. If the suppressor 28 is remote from the FAM 30, the capacitor 48 may be packaged with the suppressor 28 if desired. The capacitors would stay charged via a "trickle charge" of power coming over the power leads 44, thus requiring only a low level power requirement.

During a suppression event, the FAM 30 receives the command from the detector 26. The microprocessor, in turn, actuates the actuation device 46 by applying a voltage from the capacitor 48 through a switching device 49, for example. A sensing element 58 associated with the actuation device 46 may be monitored by the microprocessor 54 to ensure that the actuation device 46 has been successfully actuated. The sensing element 54 may be a pressure transducer, for example, which detects a drop in suppression pressure resulting from desired dispensing of suppressant into the suppression area 29 (FIG. 1B).

With the FAM 30 being an integral part of the suppressor 28, or located in close proximity to the suppressor 28, an opportunity to use the lowest possible power to activate the suppressor 28 exists. For example, only 1.0 amp could be used to activate a suppressor 28. In this manner, due to the close proximity, robust electromagnetic interference (EMI) protection can be incorporated to eliminate inadvertent discharges, due to potential EMI causes.

Upon command from the detectors 26 or controller 12, the FAM 30 would release the energy in the capacitors to activate the suppressor 28. The FAM 30 would also be able to verify that the suppressor 28 was activated by the resultant low pressure in the suppressor 28 via the pressure switch/transducer, and report this status to the controller 12. The FAM 30 would also report the suppressor 28 as being faulted, since it had been activated and no longer has any internal pressure, thus causing a maintenance action by the system maintainers.

The FAM 30 has the ability to perform a Built In Test (BIT) of itself to determine if it is functioning properly. It can perform BIT on a periodic basis, or by command from the controller 12, and report the status to the controller 12. Faulted FAMs 30 can be self-deactivated, or deactivated by the controller 12 to avoid inadvertent discharges since the unit is not functioning correctly.

Since the example FAM 30 contains the microprocessor 54, another option that can be used in the FAM 30 is to download into its NVRAM the CAGE code, Part Number, and Serial Number (for that particular unit) at the time of manufacturer. When a unit is faulted, the controller 12 can issue a message as to the zone, part number, and serial number of the unit that is faulted. Since a physical nameplate will also be on the FAM 30, the part number and serial number on the nameplate will aid the system maintainer in identifying the component to be replaced.

The controller 12 does not command the FAM 30's to activate a suppressor 28 when it is operating under its normal, automatic and autonomous mode of operation. However, it can initiate a discharge of the suppressor 28 within a specified zone(s) from the control panel when a person inputs the correct command via the controller 12 and/or remote control panel 36. As described above, each detector 26, suppressor 28, FAM 30 and ancillary component has a defined zone. In this manner, for example, if a fire or explosion event is detected in "Zone 3", and meets the requirements of AND/OR logic, the detector(s) can broadcast a message that indicates "every FAM 30 in Zone 3 should activate their suppressor 28". In this manner, communications with the controller 12 is not needed to activate the suppressor 28. The controller 12 will also "see" the same broadcast message, and store this event in its NVRAM. It can also verify that each FAM 30 has taken the commanded action, and that indeed each suppressor 28 was successfully activated by communication with each FAM 30 in the zone.

The HIDB system 10 desires that each detector 26 and suppressor 28 operate on a "zone" basis. It is also desirable to have all other components also operate on a zone basis rather than being "hard wired" to the controller 12. The microprocessor 54 of an example FAM 30 is shown in FIG. 3. In this manner, the greatest flexibility and functionality is achieved in the HIDB system 10. The zone identification is programmed in the network wiring harness mating connectors 50, which includes one or more zone identification elements 52. The method of programming the zone number or zone assignment in the mating connector can take several forms, such as using multiple connector pins connected to "ground" indicating a zone number via a binary counting method, or by using single or multiple pins with embedded resistors where each resistor value represents a zone. Other zone identification elements can also be used, but are embedded in the mating wiring harness to retain component configuration independence. There is no limit to the number of zones or components that can be used in the HIDB system 10. The microprocessor within the detector, FAM 30, or ancillary equipment will interpret the zone number, and thus establish its own zone location, and also broadcast it to the controller 12 at power-up to verify that it is present in the network and also if it functioning properly or it is faulted.

With the zone identification built into the mating connector harness it allows all detectors 26, suppressors 28, FAMs 30 and ancillary components to be manufactured and/or programmed to be independent of their end use location in a network, and allows them to be interchangeable with other vehicles, buildings, networks or zones.

Returning to FIG. 1A, the optional Network Configuration Device (NCD 34) allows the manufacture of a universal controller 12 that is independent of a network configuration. This allows the controller 12 to be used in multiple applications without modification. At controller power-up, it reads the NCD 34 and determines what the network configuration should be, then verifies that it is correct and functioning properly, zone by zone, and component by component. This is easily accomplished, as each device has determined its zone at power-up, as described above, and can report its device type (detector 26, suppressor 28, FAM 30), and zone identification.

The purpose and function of the NCD 34 is to provide the desired network configuration to the controller 12, thus allowing the controller 12 to be manufactured independent of the network it will be used in. The NCD 34 provides a network map, which is loaded in NVRAM of the controller 12 at power up, which identifies the configuration of the devices in the network, zone by zone, component by component.

The NCD 34 can support dual or single data bus interfaces, and would typically be located separate from the controller 12 as a component. However, the NCD 34 may be plugged directly into the controller 12, as illustrated in FIG. 4. In this manner, if components need to be added, removed, or changed in a network, the only change desired would be to change the NCD 34 network map rather than reprogramming the controller 12. Therefore, once the physical changes have been made to the components in the network, and the NCD 34 updated, the controller 12 is ready to fully function at the next power-up.

Typical items loaded into the NCD 34 NVRAM would be, but are not limited to:

1) Dual or single data bus usage
2) Detector part numbers and quantities by zone
3) FAM part numbers and quantities by zone
4) AND logic, OR logic, or discrimination logic by zone
5) Whether fast response discrete wiring is used for ANDing or discrimination logic by zone (desired for fast response times), or if data bus ANDing or discrimination logic will be performed via data bus communication by zone
6) Have the FAM in specific zones count the number of detectors in alarm and activate the suppressors
7) Remote control panels, and type by zone
8) Battery Back-Up Units (BBU) by zone
9) Manual discharge zones
10) Vehicle data bus interface
11) The activation of suppressors adjacent to the zone in which a fire event was detected A back-up source of power or BBU 40 (FIG. 1A) may be provided when the main power 11 is lost. Such examples are combat vehicles whose main battery may have been disabled during an event, or a manufacturing facility that needs critical areas protected during a power outage. The BBU 40 are generally sized to provide power for detection and suppressor activation for a specified period of time. These times are application dependent. If desired, multiple smaller BBU 40 could be used to avoid the use of a single larger BBU 40. In one example, the BBU 40 contains a microprocessor which interfaces with the electronic charging and voltage monitoring circuitry within the BBU 40. This microprocessor can also be the interface to the dual or single data bus.

The BBU 40 has the ability to perform a Built In Test (BIT) of itself to determine if it is functioning properly or if the batteries are in a degraded mode or uncharged. It can perform BIT on a periodic basis, or by command from the controller 12, and report the status to the controller 12. Faulted BBU 40 can be self-deactivated, or deactivated by the controller 12.

In some instances, there may not be room for a controller 12 housing on a vehicle instrument panel or other types of panels, so the controller 12 is located away from the panel and a small control panel 36 is used which interfaces with the controller 12. The controller 12 may have its own control panel built into the housing, and other control panels on the network can also control the system.

The control panel 36 can be in many forms, with push buttons, switches, touch screen controls, and/or many types of visual indicators, etc. Multiple control panels may be desired, depending upon vehicle configurations, or facility layouts. Some panels can be restricted to just performing test functions, while others may have full control of the system.

Regardless of its configuration, style, or functionality, the control panel contains a microprocessor which interfaces with the electronic circuitry within the panel. This microprocessor can also be the interface to the dual or single data bus. All control panel communications would be made over the dual or single data bus interface.

The control panel would have the ability to perform a Built In Test (BIT) of itself to determine if it is functioning properly. It can perform BIT on a periodic basis, or by command from the controller 12, and report the status to the controller 12. Faulted control panels can be self-deactivated, or deactivated by the controller 12.

Primary power 11 and return would be provided to the controller 12, and if used, the BBU 40(s). The controller 12 provides power to all components on the network except for the BBU 40, if used. In this manner the controller 12 can provide all power-up sequencing for verification of the network and zone configurations. If a BBU 40 is used, communication would first be made with the BBU 40 before performing other network configuration verification.

In many applications vehicles and buildings use centralized computers to monitor overall status of a facility or vehicle. The controller 12 can support this interface, providing the operating status, status of events or faults, accepting requests from, and providing responses to the centralized computer. This interface can be made over multiple different data base protocols, and can differ from the data base format that is used to control the network components.

Although an example embodiment has been disclosed, a worker of ordinary skill in this art would recognize that certain modifications would come within the scope of the claims. For that reason, the following claims should be studied to determine their true scope and content.

The invention claimed is:

1. A fire extinguishing system comprising:

a wiring harness including:

a connector having a pair of power leads and a pair of command leads; and at least one zone identification element built into the wiring harness and in communication with the connector and configured to provide a zone identification assignment to the connector;

a component connected to the connector, the component includes a microprocessor configured to interpret the zone identification assignment and establish a zone location in response thereto; and a controller connected to the wiring harness and configured to receive the zone location from the component.

2. The system according to claim 1, wherein the zone identification element is a resistor corresponding to the zone location assignment.

3. The system according to claim 1, wherein the zone identification element is at least one pin providing a binary number corresponding to the zone location assignment.

4. The system according to claim 1, wherein the component is a detector connected to the connector, the detector taking the zone location assignment.

5. The system according to claim 1, wherein the component is a suppressor connected to the connector, the suppressor taking the zone location assignment.

6. The system according to claim 1, comprising a zone, the zone including multiple connectors having zone identification elements corresponding to the same zone location assignment.

7. The system according to claim 1, wherein the wiring harness is configured to be connected to an external device.

8. The system according to claim 7, wherein the external device is one of a detector, a suppressor, and a fire extinguishing activation module.

* * * * *